US005209482A

United States Patent [19]

Hopfer

[11] Patent Number: 5,209,482

[45] Date of Patent: May 11, 1993

[54] GOLF SWING TRAINING AND EXERCISING DEVICE

[75] Inventor: William W. Hopfer, Rockwall, Tex.

[73] Assignee: Swingflex Systems, Inc., Dallas, Tex.

[21] Appl. No.: 824,016

[22] Filed: Jan. 22, 1992

[51] Int. Cl.[5] ..... A63B 69/36; A63B 21/04; A63B 21/12

[52] U.S. Cl. ..... 273/187.2; 273/191 B; 273/188 R; 482/124; 482/129; 482/904

[58] Field of Search ..... 482/904, 129, 23, 24, 482/74, 130, 121, 122, 123, 124; 273/191 A, 191 B, 188 R, 187.2

[56] References Cited

U.S. PATENT DOCUMENTS

| | | | |
|---|---|---|---|
| 650,656 | 5/1900 | Raabe | 482/124 |
| 1,432,013 | 10/1922 | Blake | 482/124 |
| 1,517,147 | 11/1924 | Burnett | 482/129 X |
| 1,618,273 | 2/1927 | Davidson | 482/124 |
| 3,618,942 | 11/1971 | Bates | 482/129 |
| 4,134,589 | 1/1979 | Arena | 482/124 X |
| 4,544,155 | 10/1985 | Wallenbrock | 482/129 |
| 4,685,671 | 8/1987 | Hagerman et al. | 482/129 X |
| 4,944,518 | 7/1990 | Flynn | 482/129 X |
| 4,948,117 | 8/1990 | Burke | 482/129 X |
| 5,048,836 | 9/1991 | Bellagamba | 482/124 X |

*Primary Examiner*—George J. Marlo
*Attorney, Agent, or Firm*—Larry B. Dwight

[57] ABSTRACT

This invention is a device to specifically develop certain muscle groups and techniques for golfers by utilizing a variable resistance means which may be attached to an object such as a door and utilizes a simulated golf club, D-handle or waist belt to permit free rotational movement of the users limb or torso through a series of exercises. The D-shaped handle having a stirrup and a roller located between the stirrup to allow axial movement of the roller and the stirrup relative to the variable resistance means. The waist belt having teeth on the rubber liner to prevent slipping of the belt upon the user turning their body. The variable resistance means being lengths of rubber tubing which vary the resistance as the user pulls against it. The exercises not only strengthen the muscles in the abdomen, hips and legs, but also perfect the technique which is preferred in the perfect golf swing, that is to first initiate lateral forward movement of the golfer's hips and to shift weight from the rearward leg to the forward leg prior to swinging through the impact position of the ball. An elbow connector also may be used to keep the golfer's elbows together throughout the swing.

2 Claims, 4 Drawing Sheets

GOLF SWING TRAINING AND EXERCISING DEVICE

BACKGROUND OF INVENTION

This is an exercise device developed at specifically developing muscles and muscle groups as well as technique for golfers including shoulder, forearm, wrist, hand, finger, leg and abdominal muscles.

Extensive research shows that while little is known about specific exercises and the benefit thereof, progressive resistant exercises have been shown to be helpful in increasing a golfers muscular strength. Research has indicated that golfers use nearly all of the muscles in their body in performing a golf swing. Most regular exercise devices actually developed the wrong types of muscles which actually hinder or get in the way of the perfect golf swing.

In U.S. Pat. No. 5,022,647 issued to Fulcher, an upper torso and limb conditioner machine utilizing weights and a series of pulley is utilized to allow the exerciser to raise and lower the weight in a series of exercises.

In U.S. Pat. No. 4,944,518 issued to Flynn, a device is shown to allow resistance against the lower portion of a swing of the golf club and is limited thereto.

In U.S. Pat. No. 4,402,504 issued to Christian discloses another exercising device utilizing weights and pulleys that one pulls his forearm against demonstrates a constant resistant type exercising device.

U.S. Pat. No. 4,600,190 issued to Berokoff discloses a specialized baseball bat having a spring for resistance against its movement.

U.S. Pat. No. 4,328,964 issued to Walls discloses an exercise device which utilizes multiple elastic ropes which attach between the handle and a fixed object.

In most of these devices the resistance is constant through the movement. It is thus desirable to provide a variable exercising device for golfers which will strengthen all of the precise muscles to increase strength and flexibility in the specific muscle groups throughout the body resulting in greater distance, better accuracy and higher trajectory for golfers.

SUMMARY OF THE INVENTION

This invention is directed at an exercising device which has anchor means to attach to a common door frame so that the device is portable, may be utilized in the office and home, carried on trips. The device attaches between the door and the door frame and then is provided with a variable resistance means which has one end connected to the anchor means on the door and another end have a snap clamp. The snap clamp is attached to a gripper means. The gripper means permits attachment to a limb or torso of the body. One embodiment of the gripper means is a D-handle which allows infinite compound rotation of the hand and writs against variable resistance in all directions. A simulated golf club is an alternate embodiment of the gripper means. In addition, the gripper means may be attached to a waist belt which fits securely around the golfer's waist to permit development of the lower abdominal muscles and leg muscles as well as a specific technique for the golf swing.

The primary object of the invention is to provide increased strength and flexibility in certain specific groups of muscles which will result in a greater distance, better accuracy and higher trajectory in the golfer's shot.

A still further object of the invention is to develop an exercising device which increases training of the specific form or technique of the golf swing.

A still further object of the invention is to provide an exercising device which provides progressive resistance or variable resistance for the golfer.

A still further object of the present invention is to provide a device which is readily usable and may be taken on business trips, to the office or wherever the user wishes and does not occupy any space of significance.

Another object of the invention is to provide a device which is economical and available to a wide range of everyday golfers.

Other and further objects of the invention will become apparent upon a detailed reading of the enclosed description and drawings.

DESCRIPTION OF DRAWINGS

The following drawings are provided for a more complete understanding of the present invention.

Numeral references are used to designate elements of the invention and like numerals are used throughout the various figures of the drawings to designate like parts.

DESCRIPTION OF A PREFERRED EMBODIMENT

Figure 10:
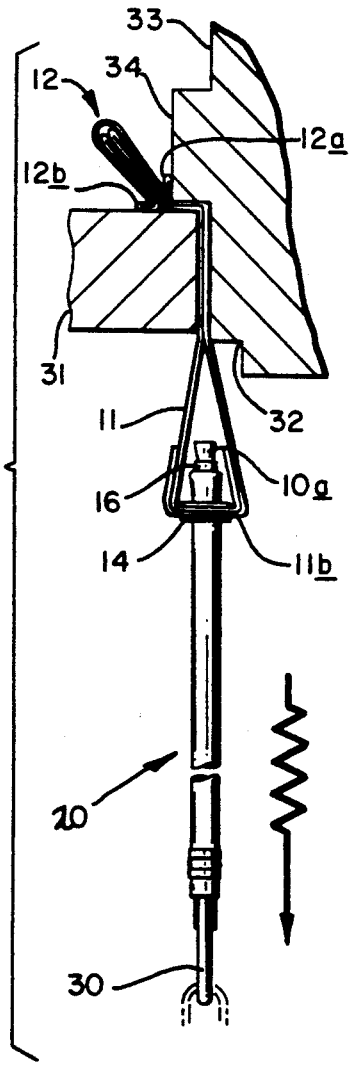
FIG. 10 is a planned view of the resistance means and attachment means attached to a typical door jamb shown in cross-section and partially fragmented.

Referring generally to FIG. 10, the exercise device consists of an anchor means 10 which may be secured between a door 31 and a typical door jam 32 having a facing 33 and a door stop 34 which traps the anchor means 10 between the door 31 and the facing 33. Variable resistance means 20 is secured between the anchor means 10 and a snap clamp 30. Gripper means such as the waist belt 40, handle 60 and golf handle 80 shown in FIGS. 1, 5, and 8 respectively and to be more fully described hereinafter is secured to the snap clamp 30.

Variable resistance means 20 provides for a varying resistance depending upon the length to which it is stretched thus allowing each person using the device to control the amount of resistance for his or her performance. The variable resistance means 20 may be comprised of a length of latex rubber tubing and may be varied by changing the diameter and depending upon the flexibility and durometer of the rubber. Thus, one can vary the strength needed to pull the tubing from a light, regular or firmer tension by varying the length and flex of tubing 20 used. The variable resistance means 20 provides a resistance which is variable during the motion of the user as the latex rubber tubing is stretched and then relaxed during portions of the exercise.

The anchor means 10 may be constructed of a piece of webbing or other flexible material such as webbing 11 which is doubled to loop over itself and has a stop means 12 having looped ends 12*a* and 12*b* secured on opposite sides of the webbing 11 by means such as stitching or other suitable fastening means to form an end 11*a*. As more fully shown in FIG. 10, the stop means 12 formed a Y-shape which is trapped between the door 31 the doorstop 34 and facing 33 to prevent the anchor means 10 from being pulled away from the door 31.

A reinforcing webbing 13 is secured over end 11*b* of the webbing 11. At the end 11*b* of webbing 11 a grommet 14 is secured through an aperture in reinforcing webbing 13 and end 11*b*. The variable resistance means 20 has the end 10*a* secured through an aperture in the grommet 14 and a stop means 15 is inserted in the end 10*a* of the tubing 20 in a clamp 16 secured over end 10*a* over the stop means 15 such that the tubing 20 cannot pull through the aperture 14*a* of the grommet 14. Stop means 15 is of larger diameter than the aperture 14*a* in grommet 14 such that the end 10*a* of tubing 20 will not pull through the grommet 14.

End 10*b* of tubing 20 is secured over shaft 32 of snap clamp 30 by a clamp 16 or other suitable fastening means. Snap clamp 30 has a spring loaded closer 31 and a shaft 32 which is preferably larger than the inside diameter of tubing 20 to provide a secure junction of the tubing 10 and shaft 32. The shaft 32 is inserted into the end 10*b* of tubing 10 and the clamp 16 is secured there over such that the shaft 32 will not pull out of the end 10*b*.

Figure 1:
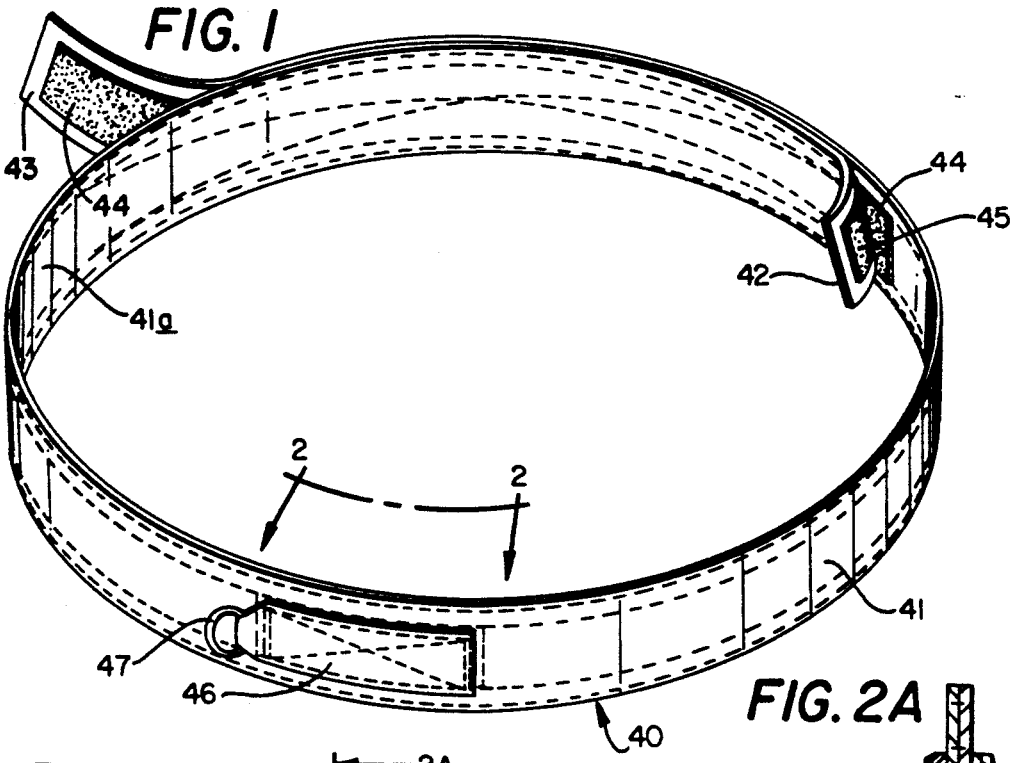
FIG. 1 is a perspective view showing the front and inner portions of the rear of the waist belt.
Figure 5:
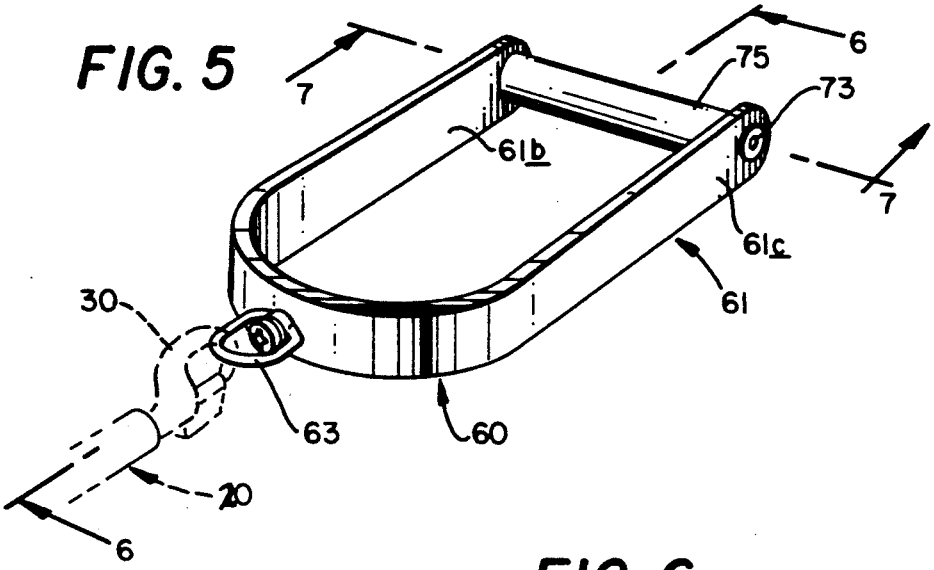
FIG. 5 is a perspective view showing the front and right side and top of the D-handle.
Figure 8:
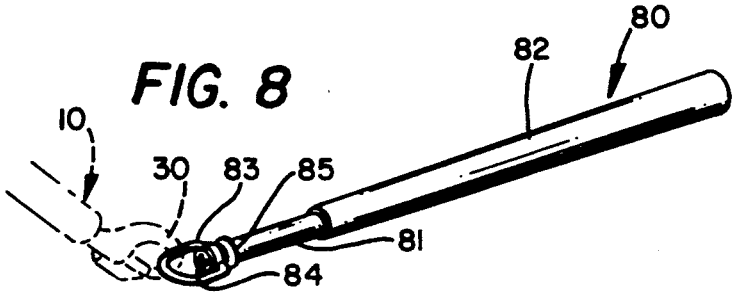
FIG. 8 is a perspective view of a golf handle attached to the end of the resistance means.

Gripper means such as waist belt 40, D-handle 60 or golf handle 80 shown in FIGS. 1, 5 and 8, respectively, forms a method for attaching to the body of the user or allowing the body of the user to grip or attach to the variable resistance means 20.

Figure 2:
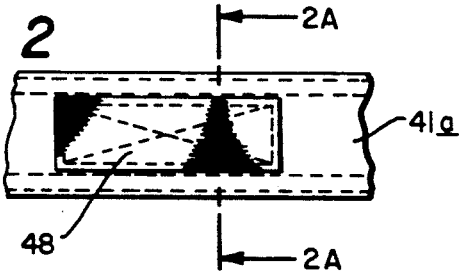
FIG. 2 is a partial fragmented view showing the inside portion of the waist belt.
Figure 2A:
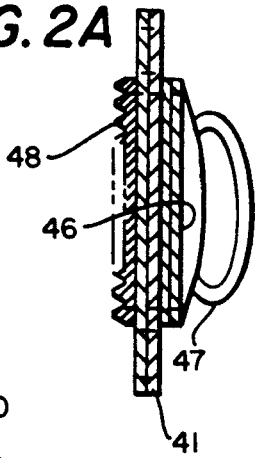
FIG. 2A is a cross-sectional view taken along line 2A—2A of FIG. 2.
Figure 3:
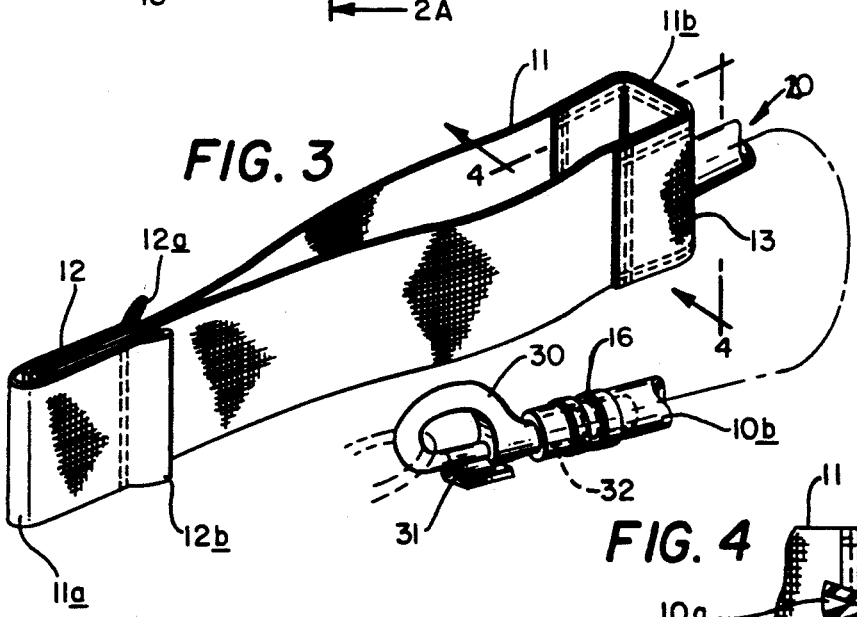
FIG. 3 is an exploded enlarged perspective view thereof.
Figure 4:
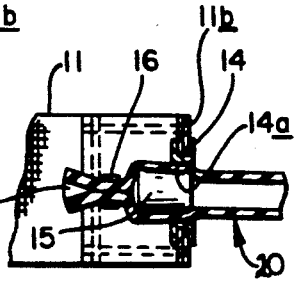
FIG. 4 is a partial cross-section view taken along line 4—4 of FIG. 3.
Figure 12:
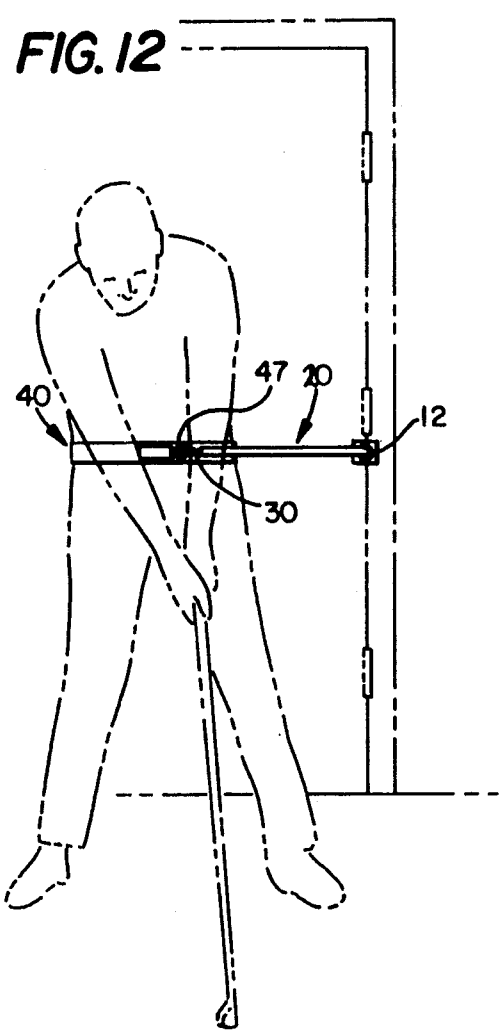
FIG. 12 is an elevation view thereof.

As more fully seen in FIGS. 1 and 2, waist belt 40 is comprised of a strip shaped webbing 41 which may be formed of vinyl or leather and would preferably have two layers sewn together to strengthen the belt 40. The belt 40 has a pair of ends 42 and 43 which overlap allowing the belt to be secured together by velcro fastening means 44 and 45 secured to opposite sides of webbing 41 adjacent to ends 42 and 43 and parallel to webbing 41. A D-ring 47 is secured to the central portion of the belt 41 by means 46 such as a strip of webbing which is doubled over and sewn to webbing 41. The D-ring 47 is positioned precisely in the middle of the webbing 41 between ends 42 and 43. On the opposite side 41*a* of webbing 41 from the D-ring 47, a strip of rubber 48 having a pyramid shaped teeth forms a non-slip surface on the rear 41*a* of webbing 41. This is secured by means such as sewing to the central portion of the belt 41. As best illustrated in FIG. 12, the belt 41 is positioned such that the D-ring 47 is positioned over the naval or slightly to the right for a right handed golfer or to the left for a left handed golfer and the belt 41 is securely fastened about the waist of the user as illustrated in dashed outline. The end 42 of webbing 41 is sufficiently long such that the smallest waist would fit with the end 42 butted up against the non-slip surface 48 or for larger waists it would expand outward and still allow the D-ring 47 to be centrally located over or adjacent to the naval of the user.

Figure 6:
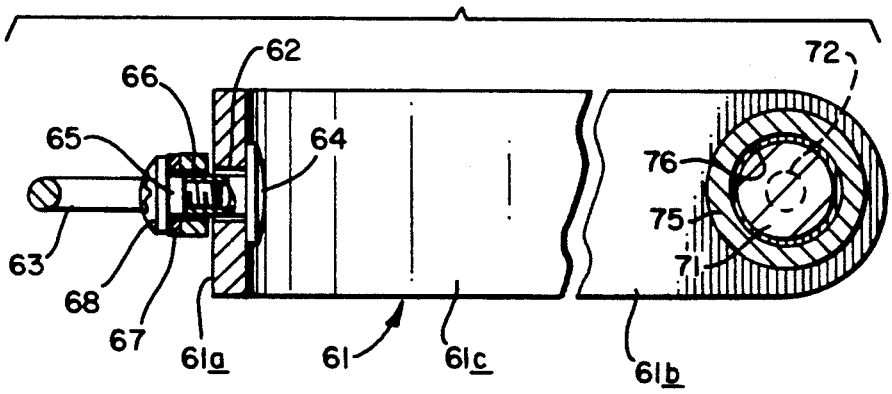
FIG. 6 is a cross-sectional view taken along line 6—6 of FIG. 5.
Figure 7:
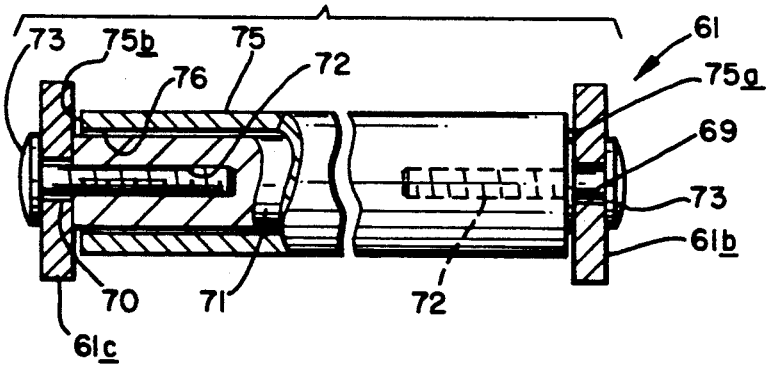
FIG. 7 is a cross-sectional view partially fragmented taken along line 7—7 of FIG. 5.

Another embodiment of the gripper means D-handle 60 is shown in FIGS. 5 through 7 and comprises a horseshoe or C-shaped stirrup 61 having an aperture 62 formed in the central portion or bend portion of the stirrup 61. A ring 63 is pivotally secured to the end of stirrup 61 over aperture 62 by means such as a female threaded bolt 64 having a shoulder 65 which passes through an aperture 66 and an aperture 66 in ring 63. A nylon or other suitable washer 67 is secured over the shoulder 65 of the female bolt 64 and a male threaded screw 68 is threaded in to the female bolt 64 through the aperture 66 of ring 63 to secure the ring to the stirrup 61. The distance between washer 67 and end 61*a* of stirrup 61 is greater than the thickness of ring 63 adjacent aperture 66 to permit ring 63 to pivot 360 degrees.

At the opposite end of stirrup 61 a pair of apertures 69 and 70 are formed in arm 61*b* and 61*c* of the stirrup 61. A cylindrically shaped spacer 71 has threaded holes 72 formed in each end thereof such that a male threaded screw 73 is threaded through apertures 69 and 70 of arm 61*b* 61*c* to hold the spacer 71 securely between the arms 61*b* and 61*c*. A hollow cylindrically shaped cylinder 75 having an inside bore 76 with a diameter greater than the outside diameter of spacer 71 such that the handle 75 is rotatable secured over spacer 71 and may freely rotate. The ends 75*a* and 75*b* are spaced from the interior surface of arm 61*b* and 61*c* so that it may freely rotate. The handle 60 permits dual rotation of the palm about the longitudinal axis of spacer 71 and rotation of the handle 60 about the axis through screw 68 and bolt 64 to permit an infinite rotation of the arm and wrist of the user. Thus, compound rotation of the muscles and bones against resistance is achieved.

A further alternative embodiment of gripper means is illustrated in FIG. 8 which simulates a golf handle 80 which comprises a shaft 81 having a grip 82 the same length and design as most of the common grips on golf clubs. A ring 83 is rotatable secured by screw 84 passing through an aperture into a threaded sleeve 85 secured to the end of shaft 81. This is fastened in much the same way the ring 63 is fastened to the stirrup 61 except the female threaded sleeve 85 is secured in the hollow portion of shaft 81. Therefore, the ring 63 allows 360 degree rotation of the handle 80 and by connection to the snap clamp 30 allows rotation in the other planes as well.

Figure 9:
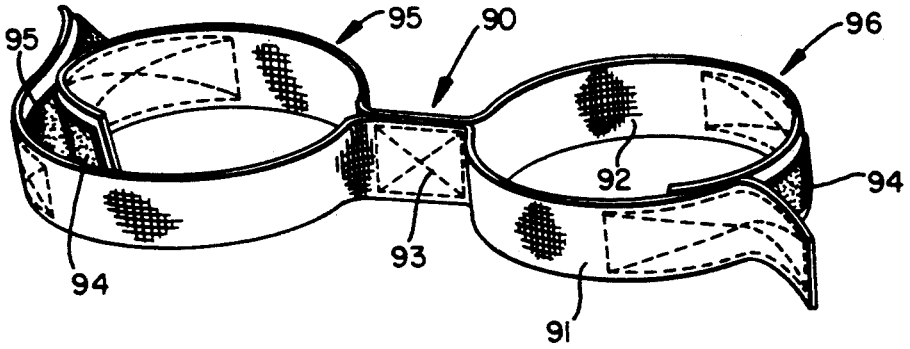
FIG. 9 is a perspective view of the shoulder and arm restraint device.

FIG. 9 illustrates an elbow connector means 90 which comprises a pair of straps or webbing 91 and 92 which are secured in the center of each strap 91 and 92 by stitching 93. Velcro attachment 94 and 95 are secured in opposing surfaces of straps 91 and 92 as the loose ends of the straps 91 and 92 are joined together to form a pair of loops 95 and 96.

The elbow connector means 90 is secured above the elbow of the user to keep the elbows in the correct position as the user swings.

Figure 11:
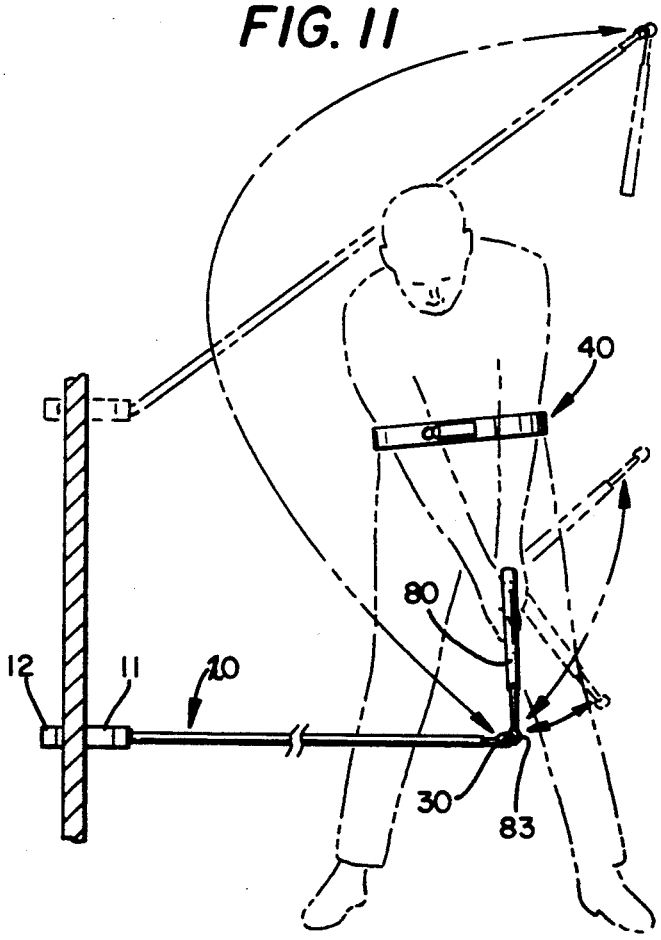
FIG. 11 is an elevational view thereof.

As further shown in FIG. 11, a typical exercise device using the golf handle 80 has the user practicing a swing utilizing the variable restraint means 20 to exercise the upper shoulders, arms, wrist and hands.

Figure 14:
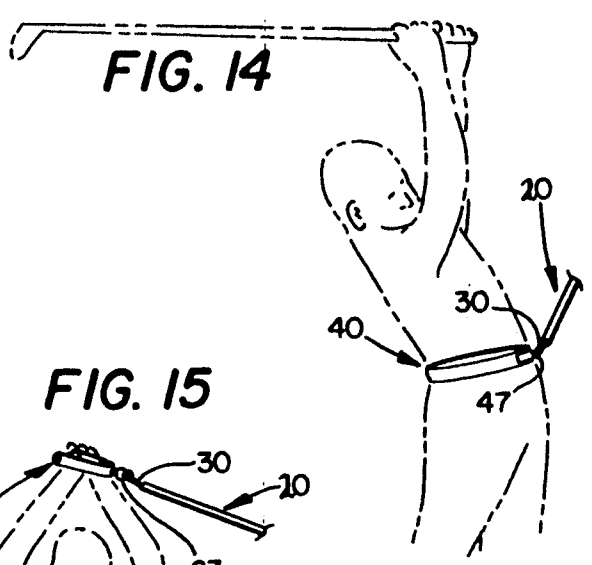
FIG. 14 is an elevational view thereof.
Figure 13:
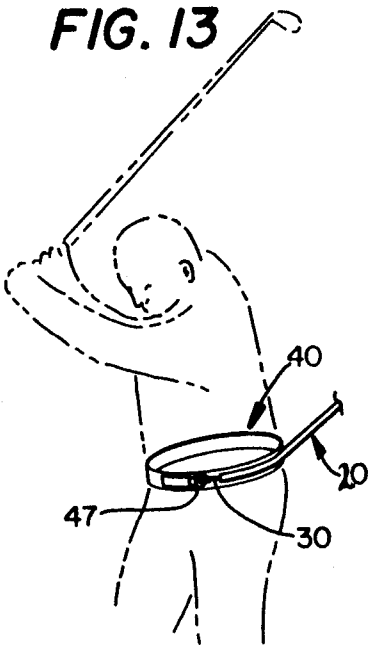
FIG. 13 is another elevation view thereof.

An alternate embodiment of the gripper means 40 is attached to the variable restraint means 20 as shown in FIG. 12 and illustrates the user utilizing the waist belt 40. The belt 40 is attached such that the D-ring 47 is over the navel of the user. The golfer stands with his back to the door with the variable resistance means 20 attached and the golfer winds up at the top of his stroke as shown in FIG. 13, the variable resistance means 20 is kept taunt. The golfer winds up against the tension of the tubing 20. As the golfer is ready to proceed with this stroke, the tension on the belt 40 causes the golfer's hips to first move laterally and shift the weight to left causing the hips to then clean the swing path and placing the weight on the left leg. Then his legs and arms continue the rotation as the club is moved as shown in FIGS. 12, 13 and 14. As the golfer finishes up as shown in FIG. 14, the tension is released.

This series of exercises not only strengthens the muscles in the abdomen, hip and legs, but also perfects the technique which is preferred in the perfect golf swing to initiate movement through the hips first. By developing movement or technique of moving the hips and legs first, the more powerful muscles of the body are initiated in the swing which actually begins to teach and strengthen and tone the muscles to provide the maximum strength and accuracy through the impact of the ball. The elbow connector 90 may be used in connection with this exercise to keep the elbows together throughout the swing.

Figure 15:
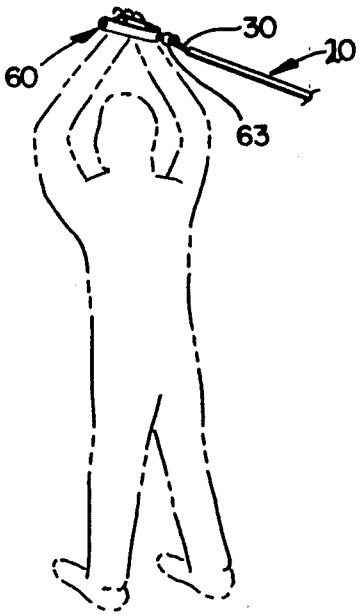
FIG. 15 is an elevational view thereof.

The D-handle 60 may be used to strengthen the arms, shoulders and wrists. One exercise is illustrated in FIG. 15 where the variable resistance means 20 comes over the back of the user and the D-handle 67 is gripped by both hands and pulled forward to strengthen not only the arms, wrist and shoulders, but in other exercises the back muscles as well.

There are other exercises with D-handle 60 by the users doing curls with a single hand with the D-handle 60 against the tension of the variable resistance means 20. Another modification includes placing the wrist between the legs and holding the D-handle and twisting the wrist in the motions with the golf club applying tension on the variable resistance means 20 to strengthen the wrist muscles. In addition, the variable resistance means 20 may be stretched out in front of the user with the club 80 and cocking and uncocking the wrist as used.

Other embodiments of the golf handle 80 are comprised in the shape of a tennis racket or baseball handle to permit the user to simulate using a tennis racket or baseball bat.

I claim:

1. A golfer's exercising device which attaches to a door and frame in a house to exercise muscle groups and perfect the technique of a proper golf swing while executing a golf club swing comprising: an elongated, resilient, variable resistance means having two ends; anchor means for fitting between a door and frame and for securing one end of the variable resistance means thereto; a snap clamp secured to the other end of the variable resistance means; a waist belt having a pair of ends and an outer and inner surface means for operably securing the ends of the waist belt together around the golfer such that the length of the belt may be varied; said ring being secured to said belt in the center between the ends thereof and on the outer surface and away from the inner surface next to the golfer as the belt is worn, said ring being adapted to be secured to said snap clamp; and a strip of rubber secured to the inner surface of the waist belt opposite the ring on the outer surface, said strip of rubber having pyramid shaped teeth formed thereon and the strip being positioned such that the teeth face inward and contact the waist of the golfer at or near the navel of the golfer when said belt is worn by the golfer with the center of the belt located at or near the golfer's navel, and the length of said variable resistance means being such that with said belt worn as aforesaid and the golfer's back to a door and frame and said anchor means and snap clamp attached as aforesaid, the golfer may execute a back swing with a golf club while putting tension on the variable resistance means, and as the golfer continues his down swing, said tension encourages the golfer's hips to first move laterally forward and the golfer's weight to shift from the rearward leg to the forward leg prior to swinging through the impact position of the ball.

2. The combination called for in claim 1 wherein the variable resistance means comprises: a length of rubber tubing.

* * * * *